United States Patent [19]

Barrett

[11] Patent Number: 4,827,823

[45] Date of Patent: May 9, 1989

[54] BULLET FIRING MECHANISM WITH RETRIEVAL CABLE

[75] Inventor: Pat B. Barrett, Houston, Tex.

[73] Assignee: Halliburton Logging Services, Inc., Houston, Tex.

[21] Appl. No.: 134,435

[22] Filed: Dec. 17, 1987

[51] Int. Cl.[4] ..... E21B 49/04

[52] U.S. Cl. ..... 89/1.15; 175/4

[58] Field of Search ..... 175/4; 89/1.15; 102/430, 464, 466, 472

[56] References Cited

U.S. PATENT DOCUMENTS

| | | | |
|---|---|---|---|
| 3,272,268 | 9/1966 | Tricon et al. | 175/4 |
| 3,517,756 | 6/1970 | Goss | 175/4 |
| 4,339,947 | 7/1982 | Wiley | 175/4 |
| 4,750,570 | 6/1988 | Barrett | 175/4 |

*Primary Examiner*—David H. Brown

*Attorney, Agent, or Firm*—William J. Beard

[57] ABSTRACT

For use in a gun supporting a bullet for obtaining a core sample therein wherein the bullet is received in a chamber in the gun, a retrieval cable connecting between a pair of studs for threading to the bullet and gun, the cable being coiled to enable the cable and heads of the stud to be received in a sacrificial plastic cylindrical housing. An electrical flow path is also provided by means of a conductor optionally positioned adjacent an exploding cap and extending to an electrically isolated ground terminal. The ground terminal connects with ground through a compressed spring extending through the housing for contact against the ground.

14 Claims, 1 Drawing Sheet

FIG. 1
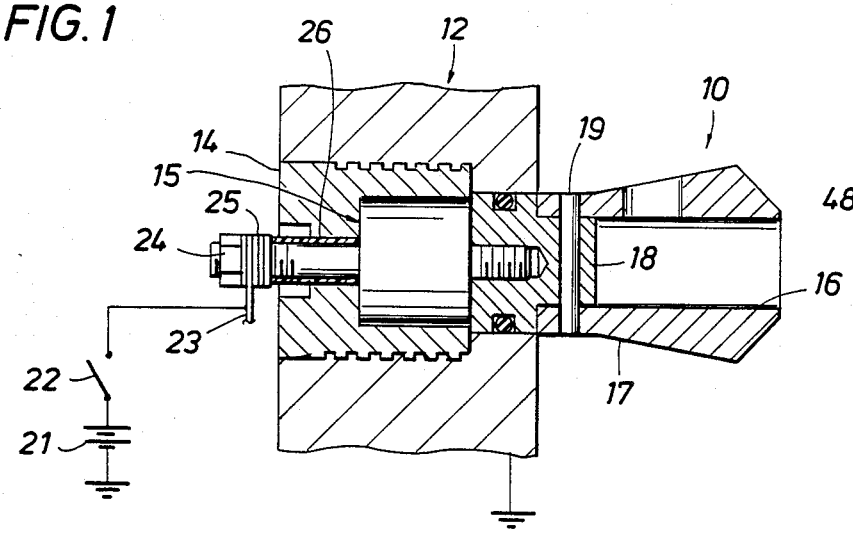
FIG. 6
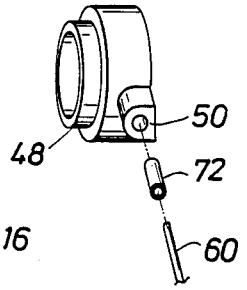
FIG. 4
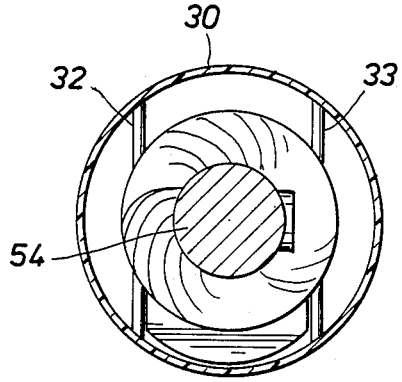
FIG. 2
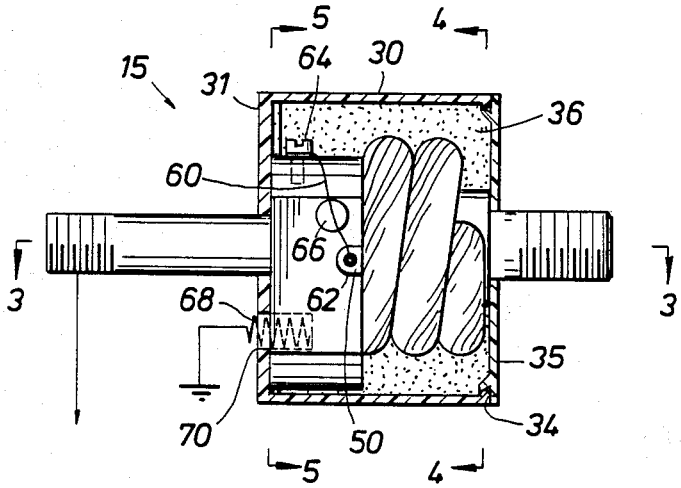
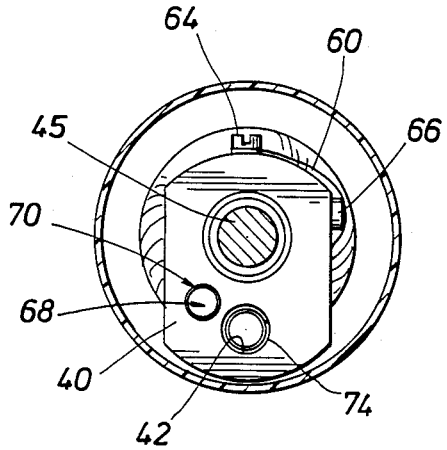
FIG. 5
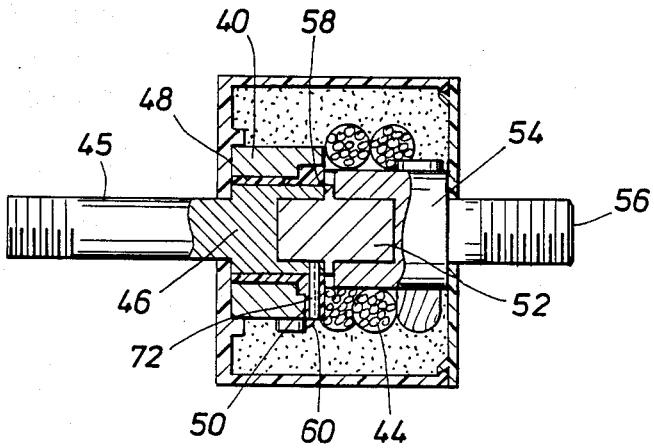
FIG. 3

BULLET FIRING MECHANISM WITH RETRIEVAL CABLE

BACKGROUND OF THE DISCLOSURE

In the process of testing a partially completed oil well, one test routine is the taking of sidewall core samples. In this procedure, a gun (holding one or more bullets) is lowerd into the well bore and the bullets are fired at the sidewall. Penetration is achieved and a cylindrical plug from the sidewall is recovered in the bullet. The gun is subsequently retrieved from the well. The bullet is connected to the gun by means of a retrieval cable. This type apparatus involves a retrieval cable and a powder charge. The equipment must also convey an electrical firing signal through the powder. This requires that certain of the metal components be insulated from one another.

Detonation of the powder is an absolute essential if a sample is to be acquired. It is sometimes difficult to assure detonation. The present apparatus is a system whereby detonation is made more certain. This apparatus is a cartridge which uniquely joins a bullet with a core sample gun, the two being joined together by means of the cartridge which bolts to the bullet to anchor one end of the retrieval cable. Additionally, a second bolt protrudes from the cartridge and extends through and out of the gun sufficiently so that electrical wiring can be connected to it for providing a circuit connection for firing current. The gun body serves as ground for the electrical system. This bullet plus cartridge is thus assembled in the gun, this being accomplished safely at the surface. The equipment is then lowered into the borehole and after use is retrieved. An exposed wire incorporated in the present equipment particularly helps to assure proper detonation of the powder around the wire. The powder is around the wire within a housing for the cartridge. The exposed hot or firing wire is used to detonate the powder. A current surge is applied to the wire which becomes hot. The small wire is rather fragile compared to the bulk of the other equipment. The present invention contemplates the use of an improved wire mounting system which anchors one end of the hot wire with a bolt or stud and eyelet, and optionally locates an exploding cap beneath the wire. The hot wire is directed through a sleeve. The sleeve shelters the wire so that it is not handled roughly. All of this equipment is located inside of a plastic cartridge case. An electrical ground must be completed through the cartridge case; a non-welded, non-soldered system is used which comprises a protruding coil spring. The coil spring extends out of the cartridge case and grounds against the body of the gun. This comprises an expendable assembly. The cartridge case can be destroyed in use. An important advantage is retrieval of the stud bolts and retrieval cable so that they can be repackaged in a new cartridge case, charged with a new charge of powder and reused time and again. Retrieval and reuse reduces the cost of this expendable apparatus.

The present apparatus is summarized as a cartridge system to be loaded into a gun adjacent to a core sampling bullet. It incorporates studs extending from opposite ends of a sacrificial cartridge case. The cartridge case encloses a powder charge and two studs together through a retrieval cable. They assemble together in a nested arrangement for compactness. A firing wire with fasteners at both ends is also included and is in adjacent proximity to powder. The firing wire is shelter by routing it through a sleeve to anchor it at the opposite end capturing an optional exploding cap. A ground system is also included which extends through the cartridge case.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a gun equipped with a cartridge of the present apparatus adapted for firing by application of a current surge through the protruding stud of the cartridge;

FIG. 2 is an enlarge sectional detail view through the cartridge case of the present apparatus showing protruding studs and a wrapped retrieval cable;

FIG. 3 is a sectional view at right angles to the sectional view of FIG. 2 illustrating additional details of construction of the cartridge case and further showing the relationship of the stud bolts;

FIG. 4 is a sectional view along the line 4—4 of the apparatus shown in FIG. 2 showing internal construction of the cartridge case;

FIG. 5 is a sectional view along the line 5—5 of FIG. 2 showing the construction of the stud and support apparatus within the cartridge case; and FIG. 6 is a detailed, exploded view showing connection of a wire to a roll pin to complete an electrical circuit.

DETAILED DESCRIPTION OF THE PREFERRED EMBODIMENT

In the drawings, attention is first directed to FIG. 1 where the numeral 10 identifies a bullet to be fired from a core sample retrieval apparatus including a gun 12. A threaded plug 14 is joined to the gun 12 to support the removable and retrievable cartridge assembly 15 of the present disclosure. The cartridge 15 is shown in enlarged view in FIG. 2 of the drawings.

To provide the context for use of the cartridge 15, the gun 12 supports one or more bullets 10. They are constructed with an internal cavity 16 to receive and capture a core sample. The bullet is formed of a bullet body 17 which is fastened to a bullet bottom 18 by means of a fastening pin 19. This forms the assembly known as the bullet. It is fired at high speed for a short distance and impacts the adjacent sidewall to collect a sample in the hollow barrel 16. The sample is subsequently analyzed to determine the nature of the formations adjacent to the well borehole. The foregoing bullet must be retrieved on a cable as will be described. The cable is not visible in FIG. 1. It is included in the cartridge 15. The cartridge 15 joins to the bullet 10 by means of a stud bolt. The cartridge is received with in a matching cylindrical hole in the plug 14. The plug threads to the gun 12 behind the cartridge and bullet in the illustrated position for firing. Firing is accomplished through the use of a suitable voltage source such as a battery 21. A switch 22 completes the electrical circuit to deliver current through the cartridge. The gun body 12 serves as electrical ground. The current is delivered through a conductor 23 which terminates in a spade or eyelet. The spade is clamped on the stud by means of a nut 24 and appropriate lock washers 25. The washers cooperate with an insulator sleeve 26 which encloses the stud to prevent the stud from grounding against the gun. If desired, the drilled passage in the plug 14 is anodized or provided with some other type of electrical insulation so that an electrical current path is completed when the switch 22 is closed and current flows through the illustrated apparatus into the cartridge 15 as will be described and then to ground. The ground path is completed to the gun 12 to assure proper detonation. On detonation, the bullet is fired at high velocity for a short distance to collect the sample in the chamber 16 for subsequent retrieval.

Attention is now directed to FIG. 2 of the drawings where the cartridge 15 is shown in greater detail. The apparatus includes a cylindrical canister 30 which has an integral bottom 31. The bottom is constructed with a pair of spaced beads 32 and 33 better shown in FIG. 4. They serve as a lock or clamp mechanism. The cartridge case 30 has an upper shoulder 34 which conveniently locks with an internal confronting lip or shoulder on lid 35. The lid 35 is sized to fit in the cartridge of cylindrical shape. The two join together and define an internal cavity or chamber which is selectively filled with powder 36. The chamber can be completely filled, or a smaller charge can be used as required. Moreover, the lid 35 snaps into place to hold against the cylindrical cartridge body 30 to assure that powder does not spill out. The protruding threaded members fit snugly at the openings of the cartridge 15 to prevent powder leakage.

The components on the interior of the cartridge housing 30 include a circular stud body 40 which is generally circular as shown in FIG. 5 except that it has flat faces on opposite sides. The two flat faces conform to the beads 32 and 33 to enable clamping of the stud body 40. The body 40 is clamped to prevent rotation. The stud body 40 is constructed of metal on the exterior. The stud body has a hole drilled at 42 (FIG. 5), which receives one end of a retrieval cable. The cable 44 is wrapped in multiple turns into a coil and has a remote end which is fastened as will be described. The stud body is also centrally hollow to receive a stud bolt. As shown in FIG. 3, a stud bolt 45 is threaded at the exposed end 48 and has an enlarged head 46 at the opposite end. This head fits within a drilled hole in the stud body 40. The head 46 is surrounded by a plastic sleeve 48 formed of insulative material. The canister 30 is preferably formed of plastic and is therefore an electrical insulator. By this construction, the stud bolt 45 is not grounded to any piece of metal which might otherwise serve as an unintended conductor. It is shown surrounded in FIG. 3 by the plastic sleeve 48. The sleeve 48 supports a radially extending hollow tube 50. The stud body 40 surrounds the exterior of the insulative sleeve 48, and has a notch to receive and align the radial tube 50. The body 40 does not contact the stud bolt 45 or any other of the metal components involved in the electrical conductive path except through a firing wire which will be detailed.

The stud head 46 has a central recessed cavity for receiving a plastic assembly plug 52. This plug extends inwardly of the head 46. The plug 52 serves as an anchor, fitting snugly, within a metal cable head 54. The cable head 54 is a circular body which is provided with a central bore to receive the upper end of the plastic plug 52. The cable head 54 is drilled with a hole perpendicular to the axis thereof to enable the coiled cable 44 to pass through that hole. The cable 44 is snugly clamped in the hole. The head 54 is integrally constructed with the protruding stud bolt 56. Recall that bolt is threaded to the bullet bottom 18 as shown in FIG. 1 of the drawings. This comprises a single piece metal member. It is conductive and for that reason, the cable head 54 must be apart; the plastic plug 52 therebetween is sufficiently long that the heads are held apart. Moreover, the plug 52 supports a radial fin 58 which assures that the two metal members do not touch and that the stud 45 (made of metal) comprises the only metal piece serially connected with the voltage source 21 as shown in FIG. 1. In other words, the metal stud 45 is electrically isolated. The stud 45 is surrounded by plastic (insulative) sleeves to assure that it is not in contact to ground. Moreover, the retrieval cable 44 is also electrically insulated in that it does not touch the metal head 46.

The electrical pathway through the cartridge is defined by a stud 45 integrally constructed with the head 46. An electrical wire 60 extends from the head 46 along the radial tube 50, the tube 50 fitting in the conforming notch 62; the wire curves externally around the stud body 40. The fastener 64 is preferably a friction held threadless roll pin or stem 64 with or without a head to enable press fitting into a smooth bore hole. The stem fits snugly in the hole and anchors one end of the wire 60. The fastener can alternately be a threaded bolt in a tapped hole. One of these fasteners assures a quality electrical connection. The outer surface of the stud body 40 is optionally used to clamp an exploding cap 66 against and under the conductor 60. The conductor 60 thus is routed along the tube 50 and through the notch 62 for mechanical safety and passes in such proximity that the cap 66 will explode when heated by the wire. As shown in FIG. 6, the wire 60 is positioned interiorly of the tube 50 and is conveniently held in place by a metal roll pin 72 which captures the wire 60. The pin 72 and wire electrically contact (at a sized hole) the metal head 46 to assure electrical connection.

In FIG. 2 of the drawings, a grounding path is completed by a compressible coil spring 68. The spring 68 passes through a hole 70 formed in the cartridge case 30. It compresses into the stud body 40 at a shallow hole which is located to match the hole 70. The spring is compressible and therefore assures good physical contact with the metal of the plug 14 which is joined to the gun 12.

The electrical pathway traces the following route. Electrical current applied from the power source 21 through the switch 22 is directed through the wire 23 and flows into the stud 45. It flows to the enlarged head 46. The head 46 is surrounded by nonconductive materials. It is electrically insulated in the arrangement of components shown in FIG. 3. Current flows from the head 46 into the conductor 60 which is joined to the metal body 46. This directs the current flow through the metallic member 40. That in turn is connected to ground by the coil spring 68 just described. The coiled cable is typically a woven cable gripped snugly at the drilled hole 42 (see FIG. 5) and can theoretically deliver current flow to the stud 56. This current flow path however is a high resistance flow path. Resistance can be assured by placing an insulative sleeve 74 in the hole 42 to thereby increase the resistance of the connection to the coiled cable. In fact, it is probably expedient that such electrical insulation be included to markedly increase resistance to current flow along the cable. If the current is provided with alternate routes to ground and one path is a relatively low resistance compared to the other path, most current will flow along the low resistance path. To this end, the conductor 60 has a selected resistance to ground which is significantly less than any other current flow path. Moreover, the current which is applied to this apparatus is typically in the range of one ampere or more. The current is normally applied in the form of a surge. When the wire 60 conducts the large surge of current, the wire temperature jumps. This temperature jump is controllable so that the conductor 60 can easily become radiant. This alone is normally sufficient to ignite the powder 36. To provide added assurance of detonation, an exploding cap 66 is tucked under the conductor 60. In view of the close spacing of the cap 66 and the relative ease with which the powder is detonated, this assures proper detonation when the current flow is applied.

Assembly of the cartridge 15 with the apparatus shown in FIG. 1 is achieved quickly and easily because the components thread together. After placing the cartridge 15 in the gun, the next assembly step is to attach the electrical conductor on the protruding stud 45. The gun is then run in the well borehole and is ultimately detonated by delivery of a current surge through the operation of switch 22. This current surge will trigger explosion of the powder 36 in the cartridge case 30. When detonation occurs, the bullet is fired at high velocity. When this occurs, the coiled cable deploys while the bullet travels away from the gun 12. The cable is deployed to hold the bullet to the gun 12. The bullet fired from the illustrated position of FIG. 1 cuts a core sample which is captured in the cavity 16. Firing may destroy the case 30, and typically also destroys the wire 60. After firing and retrieval, the cable 44 is substantially undamaged. The metal components are also substantially undamaged. The two studs are undamaged. After retrieval, the two studs can then be unthreaded from the gun and bullet with the cable connected between them. The cable is then recoiled to resemble the arrangement shown in FIG. 2. This enables reuse of the cable and the attached studs. Preparation for reuse of the cable and the attached studs includes replacement of the spring 68 and replacement of the conductor 60. Optionally, the exploding cap 66 can also be included. This equipment is positioned in a new cartridge case 30. Before the cap 35 is placed on the case, the proper amount of powder is placed in the case and the cartridge cap is then pressed snugly around the lip 34 to obtain closure. Reuse can be repeated indefinitely so long as the components are not seriously damaged. Typically, on each new use of the equipment, the plastic case 30 is replaced, and the electrical conductor 60 and the coil spring 68 are replaced. Each reconstruction primarily involves reclaiming the coiled cable along with the two studs and equipping the substantially durable components with the sacrificial cartridge case 30, the lid 35, a new charge of powder 36, the conductor 60, the cap 66 and the coil spring 68.

As desired, the case can be marked on the exterior with various marking devices or raised symbols to indicate the powder load. Other indicia can also be placed on the exterior for convenient readings by service personnel assembling the bullet to the gun 12.

While the foregoing is directed to the preferred embodiment, the scope thereof is determined by the claims which follow.

What is claimed is:

1. For use in a core sample collecting gun for firing a bullet subject to retrieval wherein the bullet has a bolt receiving means and wherein the bullet is fired from a gun having a stud receiving means therein, a cartridge for electrical firing of the bullet which comprises:

(a) a sacrificial closed housing of fixed external size and shape, said housing adapted to receive therein powder to be ignited for firing a bullet;

(b) retrieval means including:

(1) a first protruding elongate stud means adapted to be received at the stud receiving means on said gun;

(2) a second protruding elongate stud means adapted to join to the bolt receiving means of said bullet; and (3) a coiled retrieval cable connected between said first and second stud means;

(c) a current conducting pathway adapted to deliver an electrical current for detonation of the powder in said housing, said current pathway including:

(1) metal in one of said studs means for providing a current pathway to the interior of said housing;

(2) a conducting wire within said housing and connected to said metal stud means, said wire adapted to become hot on current flow therethrough sufficient to ignite the powder;

(3) means for routing said wire from said metal stud means to a ground terminal means; and (4) ground connector means electrically connecting from said ground terminal means to the gun to provide a current flow path to ground defined at least partially by an electrical insulation means electrically isolating current so that current flows through said conducting wire to electrical ground, to enable current flow through said wire to ignite said powder in said housing.

2. The apparatus of claim 1 wherein said wire is constructed with a loop at one end and that loop is anchored beneath a head of a bolt to assure adequate electrical connection.

3. The apparatus of claim 1 wherein said housing 30 includes internally located integrally constructed ribs for aligning said retrieval means therein.

4. The apparatus of claim 1 wherein said ground connector means comprises a compressible coil spring made of electrically conductive material.

5. The apparatus of claim 1 wherein said wire connects at one end to a bolt anchored metal member as part of the electrical conducting pathway.

6. The apparatus of claim 1 wherein said housing comprises a separate, removable lid having a mating edge with a circular, hollow cylindrical housing, and said lid and housing position axially located opposing holes therein to enable said first and second stud means to extend therethrough.

7. The apparatus of claim 1 wherein said first stud means incorporates a head said head being surrounded by an encircling insulator sleeve means, a larger metal member 40 thereabout, and said wire passes through a hollow means formed for said conductor to provide a sheltered pathway for said wire.

8. The apparatus of claim 1 including an explosive cap 66 positioned adjacent to said wire.

9. The apparatus of claim 1 including a removable lid on said housing for enabling said powder to be placed in said housing.

10. The apparatus of claim 9 including a locking means for joining said lid to said housing.

11. A kit for use with a core sample bullet and gun retrieval cable, the cable extending between cable end connected stud bolts which are constructed to be anchored to a gun and bullet for retrieval of the bullet on the cable, the kit comprising:

(a) a cylindrical, hollow, sacrificial hollow housing and cooperative lid adapted to receive therein said retrieval cable and portions of said stud bolts;

(b) a powder charge adapted to be placed in said housing; and (c) electrical conductor means including a wire adapted to be heated for igniting the powder and further including ground conductor means for extending out of said housing to make contact with the gun to obtain an electrical ground.

12. The kit of claim 11 further including an explosive cap for positioning next to said conductor means to ignite said powder.

13. The kit of claim 11 wherein including snap means to join said lid to said housing.

14. The kit of claim 11 wherein said conductor means includes end located means for engaging a bolt beneath a bolt head.

* * * * *